US011965683B2

(12) United States Patent
Ryu et al.

(10) Patent No.: US 11,965,683 B2
(45) Date of Patent: Apr. 23, 2024

(54) COOLING SYSTEM FOR LOW TEMPERATURE STORAGE

(71) Applicant: LG ELECTRONICS INC., Seoul (KR)

(72) Inventors: Byoungjin Ryu, Seoul (KR); Yoonho Yoo, Seoul (KR); Jaeheuk Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 704 days.

(21) Appl. No.: 17/047,205

(22) PCT Filed: Apr. 19, 2019

(86) PCT No.: PCT/KR2019/004777
§ 371 (c)(1),
(2) Date: Oct. 13, 2020

(87) PCT Pub. No.: WO2019/203620
PCT Pub. Date: Oct. 24, 2019

(65) Prior Publication Data

US 2021/0164711 A1 Jun. 3, 2021

(30) Foreign Application Priority Data

Apr. 20, 2018 (KR) ..... 10-2018-0046186

(51) Int. Cl.
*F25B 47/02* (2006.01)
*F25B 41/20* (2021.01)
*F25B 41/24* (2021.01)

(52) U.S. Cl.
CPC ..... *F25B 47/022* (2013.01); *F25B 41/20* (2021.01); *F25B 41/24* (2021.01);
(Continued)

(58) Field of Classification Search
CPC ..... F25B 47/022; F25B 41/20; F25B 41/24; F25B 41/26; F25B 2313/007; F25B 2313/0231; F25B 2313/02322
See application file for complete search history.

(56) References Cited

U.S. PATENT DOCUMENTS 7,308,800 B2 * 12/2007 Park ..... F25B 47/022 62/159
7,716,941 B2 * 5/2010 Park ..... F25B 13/00 62/277

(Continued)

FOREIGN PATENT DOCUMENTS

DE 102019200673 A1 * 7/2020
EP 1437557 A1 * 7/2004 ..... F25B 13/00

(Continued)

OTHER PUBLICATIONS

International Search Report (with English Translation) dated Jul. 15, 2019 issued in Application No. PCT/KR2019/04777.

(Continued)

*Primary Examiner* — Miguel A Diaz
(74) *Attorney, Agent, or Firm* — KED & ASSOCIATES

(57) ABSTRACT

The present invention relates to a cooling system for a low temperature storage. The cooling system for the low temperature storage according to an embodiment of the present invention comprises: a first outdoor valve disposed between a compressor and an outdoor heat exchanger and selectively restricting an inflow of a refrigerant into the outdoor heat exchanger; and a first bypass pipe branched from an inlet side of the first outdoor valve and guiding the refrigerant to bypass the outdoor heat exchanger, so that the refrigerant can be guided to bypass the outdoor heat exchanger during defrosting operation of the cooling system.

14 Claims, 4 Drawing Sheets

(52) U.S. Cl.
CPC . *F25B 2313/007* (2013.01); *F25B 2313/0231* (2013.01); *F25B 2313/02322* (2013.01)

(56) References Cited

U.S. PATENT DOCUMENTS

| | | | | |
|---|---|---|---|---|
| 11,512,881 | B2 * | 11/2022 | Kim | F25B 47/025 |
| 2004/0134205 | A1 * | 7/2004 | Park | F25B 13/00 62/277 |
| 2011/0271703 | A1 | 11/2011 | Park et al. | |
| 2016/0201960 | A1 * | 7/2016 | Miyakoshi | B60H 1/00385 62/154 |
| 2016/0238290 | A1 * | 8/2016 | Bae | F24F 1/32 |
| 2018/0328635 | A1 * | 11/2018 | Tashiro | F25B 41/26 |
| 2019/0346189 | A1 * | 11/2019 | Saito | F25B 30/02 |
| 2022/0221196 | A1 * | 7/2022 | Yoshimi | F24F 11/67 |

FOREIGN PATENT DOCUMENTS

| | | | | |
|---|---|---|---|---|
| JP | H07-117323 | | 12/1995 | |
| JP | H07117324 | * | 12/1995 | F25B 47/02 |
| JP | 2000-121232 | | 4/2000 | |
| JP | 2017-172920 | | 9/2017 | |
| KR | 10-2004-0064456 | | 7/2004 | |
| KR | 100504509 | B1 * | 8/2005 | |
| KR | 10-0885583 | | 2/2009 | |
| KR | 10-1266936 | | 5/2013 | |
| KR | 10-2014-0125141 | | 10/2014 | |
| KR | 10-1700043 | | 1/2017 | |
| KR | 2017-015299 | | 1/2017 | |
| KR | 2018-040547 | | 3/2018 | |
| KR | 1867858 | B1 * | 6/2018 | F25B 41/04 |
| KR | 20190126553 | A * | 11/2019 | |
| KR | 20190128360 | A * | 11/2019 | |
| WO | WO-2019203620 | A1 * | 10/2019 | F25B 41/22 |

OTHER PUBLICATIONS

Korean Office Action dated Mar. 23, 2023.
Korean Notice of Allowance dated Sep. 1, 2023 issued in Application No. 10-2018-0046186.

* cited by examiner

COOLING SYSTEM FOR LOW TEMPERATURE STORAGE

CROSS-REFERENCE TO RELATED PATENT APPLICATIONS

This application is a U.S. National Stage Application under 35 U.S.C. § 371 of PCT Application No. PCT/KR2019/004777, filed Apr. 19, 2019, which claims priority to Korean Patent Application Nos. 10-2018-0046186, filed Apr. 20, 2018, whose entire disclosure is hereby incorporated by reference.

TECHNICAL FIELD

The present disclosure relates to a cooling system for a low temperature storage.

BACKGROUND ART

A cooling system for cooling a low temperature storage may be generally understood as a cooling system for cooling a large warehouse of a factory in which low temperatures, in particular, sub-zero temperatures must be maintained or a food storage (showcase) in which refrigerating/freezing is required.

In a process of driving the cooling system, a phenomenon in which frosting of an evaporator included in the system is made may occur. In order to remove the frost, the cooling system needs to perform a defrosting operation. As an example, the defrosting operation may be performed periodically, or may be performed when an evaporation temperature of the evaporator is less than or equal to a set temperature.

Conventionally, in order to perform the defrosting operation, the cooling system is configured such that an electric heater is installed at a position adjacent to the evaporator. When the electric heater is driven, heat generated from the electric heater is transferred to the evaporator, so that the frost can be removed.

Information on the related prior patent documents is as follows.

PRIOR PATENT LITERATURE

Korean Patent Registration number: 10-1266936, Registration date: May 16, 2013

Title of invention: Eco-friendly storage control device for reducing carbon generation However, according to such a conventional defrosting method using a heater, there were the following problems.

First, there is a problem that a cost increases due to consumption in excessive electric energy.

Second, the cooling operation through the evaporator is stopped while the defrosting operation by the heater is performed, so that the temperature of the storage is raised, and accordingly, causing a problem in which the freshness of food stored in the storage is lowered.

Third, there is a problem that the replacement or repair cost of the heater increases due to frequent failure of the heater.

DISCLOSURE

Technical Problem

The present disclosure has been proposed in order to solve this problem, and an object of the present disclosure is to provide a cooling system for a low temperature storage, capable of performing a defrosting operation of a first evaporator using hot gas.

In addition, another object of the present disclosure is to provide a cooling system for a low temperature storage, in which a condensed refrigerant which has undergone defrosting is expanded and evaporated in a second evaporator to simultaneously perform a defrosting operation and a cooling operation.

In addition, still another object of the present disclosure is to provide a cooling system for a low temperature storage, which includes a bypass pipe extending from an outlet side of an evaporator to an inlet side of an outdoor heat exchanger to guide the refrigerant passing through the evaporator to an outdoor heat exchanger through the bypass pipe during a defrosting operation to enable the outdoor heat exchanger to function as an evaporator, thereby obtaining an amount of heat required for defrosting from an outdoor air heat source.

Technical Solution

According to an embodiment of the present disclosure, a cooling system for a low temperature storage includes a first outdoor valve disposed between a compressor and an outdoor heat exchanger to selectively restrict inflow of refrigerant into the outdoor heat exchanger, and a first bypass pipe branched from an inlet side of the first outdoor valve to guide the refrigerant to bypass the outdoor heat exchanger, thereby guiding the refrigerant to bypass the outdoor heat exchanger when the defrosting operation of the cooling system is performed.

In addition, the cooling system may further include suction connection pipe branched from an outlet side of the first outdoor valve to guide a refrigerant passing through the outdoor heat exchanger to a suction side of the compressor, thereby using the heat amount of the outside air heat-exchanged in the outdoor heat exchanger as the amount of defrost heat during the defrosting operation.

In addition, the cooling system may further include a first evaporator into which a refrigerant flowing through the first bypass pipe is introduced to perform defrost, and a second evaporator disposed at an outlet side of the first evaporator to evaporate a refrigerant passing through the first evaporator to simultaneously perform a defrosting operation of a certain evaporator and a cooling operation of another evaporator.

In addition, the cooling system may further include a discharge pipe configured to extend from the outlet side of the compressor to the outdoor heat exchanger, and a liquid pipe disposed at an outlet side of the outdoor heat exchanger, a refrigerant condensed in the outdoor heat exchanger flowing through the liquid pipe.

The discharge pipe may include a first branch portion connected to one end of the first bypass pipe, and a second branch portion to which the suction connection pipe is connected, thereby facilitating the configuration of the first bypass pipe and the suction connection pipe.

The cooling system may further includes a third branch portion formed in the liquid pipe, and a second bypass pipe connected to the third branch portion, a refrigerant defrosted in the first evaporator flowing through the second bypass pipe, so that the refrigerant which has defrosted some evaporators can easily flow to the outdoor heat exchanger during the defrosting operation.

The cooling system may further include a bypass expansion device disposed in the second bypass pipe.

The liquid pipe may further include a fourth branch portion to which the other end of the first bypass pipe is connected.

The cooling system may further include a first connection pipe connected to the liquid pipe and to which a first defrost valve is disposed, and a third bypass pipe branched from the first connection pipe to guide a refrigerant to the first evaporator.

The cooling system may further include a first evaporator outlet pipe connected to the first evaporator, and a second defrost valve connected to the third bypass pipe and the first evaporator outlet pipe.

The cooling system may further include a connection pipe branched from the third bypass pipe, a second evaporator outlet pipe connected to the second evaporator, and a third defrost valve connected to the connection pipe and the second evaporator outlet pipe.

The cooling system may further include a gas tube disposed at a suction side of the compressor, a refrigerant evaporated in the second evaporator flowing through the gas tube, and the gas tube may include a fifth branch portion to which the suction connection pipe is connected.

The cooling system may further include a second outdoor valve disposed in the first bypass pipe.

The cooling system may further include a third outdoor valve disposed in the suction connection pipe.

The cooling system may further include an outdoor unit in which the compressor and the outdoor heat exchanger are disposed, and an indoor unit in which the first and second evaporators are disposed, and a connection unit disposed between the outdoor unit and the indoor unit and connected to the outdoor unit with three-way pipe and to the indoor unit with three-way pipe.

Advantageous Effects

According to the present disclosure as described above, since the defrosting operation of the first evaporator may be performed using hot gas, a defrost time is shortened and energy consumption for defrosting may be reduced.

In addition, since a condensed refrigerant that has undergone defrosting may be expanded and evaporated in the second evaporator, there is an effect that the defrosting operation and the cooling operation can be simultaneously performed.

In addition, a refrigerant which has defrosted the first evaporator is guided to the outdoor heat exchanger, so that the outdoor heat exchanger functions as an evaporator during the defrosting operation, thereby obtaining the amount of heat required for defrosting from the outdoor air heat source to improve the efficiency of the defrosting operation.

MODE FOR INVENTION

Hereinafter, embodiments of the present disclosure will be described in more detail with reference to the drawings. However, the spirit of the present disclosure is not limited to the presented embodiments, and those skilled in the art who understand the spirit of the present disclosure will be able to easily propose other embodiments within the scope of the same idea.

Figure 1:
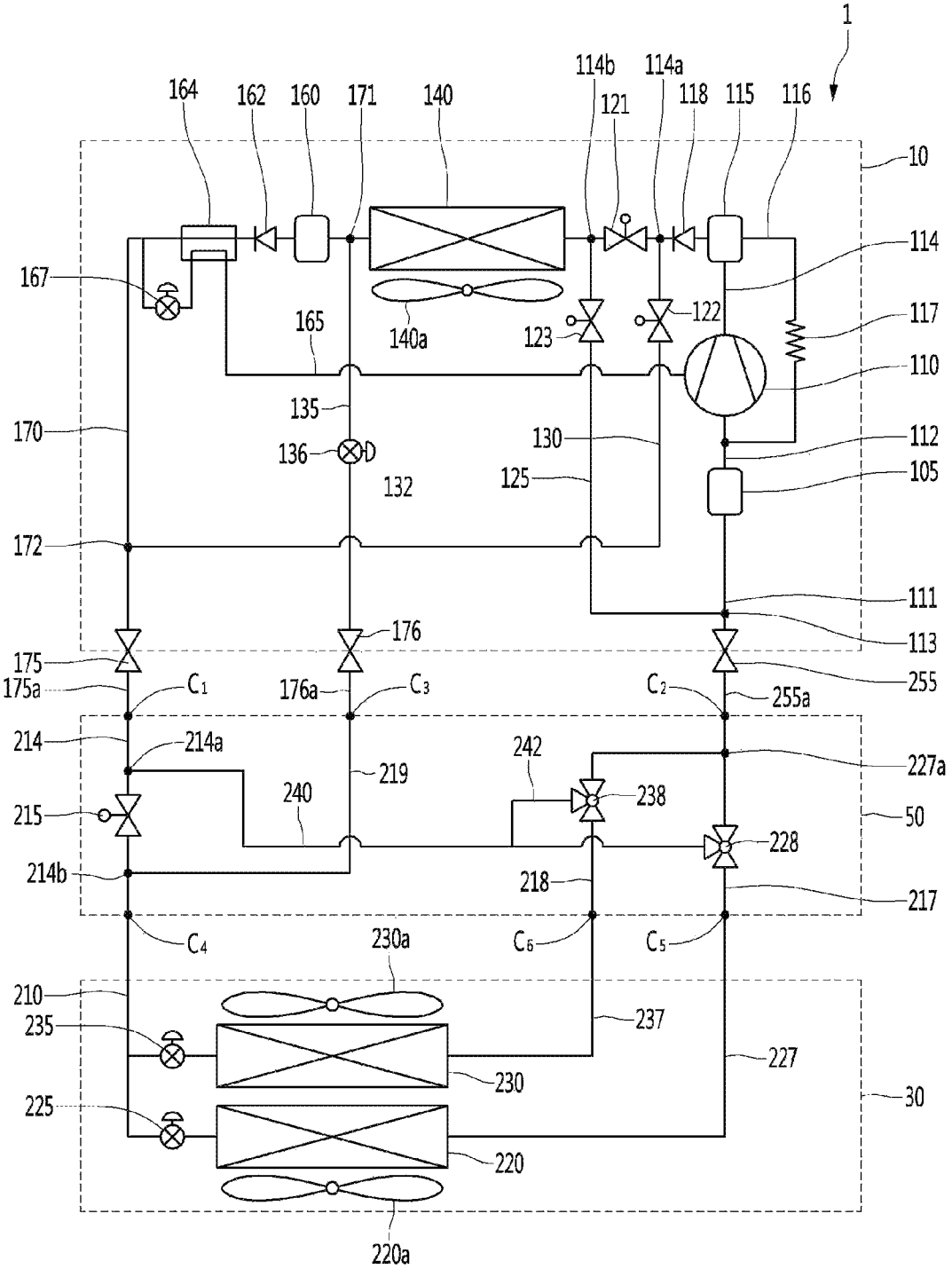
FIG. 1 is a cycle diagram showing the configuration of a cooling system according to an embodiment of the present disclosure.

FIG. 1 is a cycle diagram showing the configuration of a cooling system according to an embodiment of the present disclosure.

Referring to FIG. 1, a cooling system 1 according to an embodiment of the present disclosure may include an outdoor unit 10 disposed outdoors, an indoor unit 30 disposed in a storage to supply cool air to maintain a low temperature of the storage, and a connection unit 50 connected between the outdoor unit 10 and the indoor unit 30 to guide the flow of a refrigerant during a defrosting operation of the cooling system 10. As an example, the cooling system 1 may cool the storage such that that an internal temperature of the storage is maintained below zero.

The connection unit 50 may be understood as a "defrosting device", which includes a plurality of refrigerant pipes and valves for guiding the flow of a refrigerant to enable a defrosting operation.

The outdoor unit 10 may be detachably connected to the connection unit 50. In detail, the outdoor unit 10 and the connection unit 50 may be connected with three-way pipe. The outdoor unit 10 may include a first service valve 175 connected to a liquid pipe 170 and a second service valve 255 connected to a gas pipe 111. The outdoor unit 10 may further include a third service valve 176 connected to a second bypass pipe 135. The second bypass pipe 135 may be understood as a liquid pipe through which a liquid refrigerant flows.

The connection unit 50 may be provided with three connection portions C1, C2, and C3 connected to the outdoor unit 10. The three connection portions C1, C2, C3 include a first connection portion C1 connected to the first service valve 175 of the outdoor unit 10, a second connection portion C2 connected to a second service valve 255 of the outdoor unit 10, and a third connection portion C3 connected to a third service valve 176 of the outdoor unit 10.

The cooling system 1 may include a first system pipe 175*a* connecting the first service valve 175 and the first connection portion C1, a second system pipe 255*a* connecting the second service valve 255 and the second connection portion C2, and a third system pipe 176*a* connecting the third service valve 176 and the third connection portion C3.

The connection unit 50 and the indoor unit 30 may be connected with three-way pipe. The connection unit 50 may be provided with three connection portions C4, C5 and C6 connected to the indoor unit 30. The three connection portions C4, C5 and C6 include a fourth connection portion C4 connected to an evaporator inlet pipe 210 provided in the indoor unit 30, a fifth connection portion C5 connected to a first evaporator outlet pipe 227 and a sixth connection portion C6 connected to a second evaporator outlet pipe 237.

The outdoor unit 10 may include a compressor 110 for compressing a refrigerant, a suction pipe 112 connected to an inlet side of the compressor 110 to guide suction of a refrigerant through the compressor 110, and a discharge pipe 114 connected to an outlet side of the compressor 110 to guide discharge of the refrigerant compressed by the compressor 110.

The suction pipe 112 may be understood as a configuration of a gas pipe extending from a gas-liquid separator 105 to a suction port of the compressor 110 to guide the flow of the refrigerant. The gas-liquid separator 105 may be disposed at the suction side of the compressor 110 to separate a gaseous refrigerant from a refrigerant and supplying the gaseous refrigerant to the compressor 110. The suction pipe 112 may guide the refrigerant discharged from the gas-liquid separator 105 to the suction port of the compressor 110.

The outdoor unit 10 may further include a gas pipe 111 extending from the second service valve 255 to the gas-liquid separator 105. The evaporated gaseous refrigerant may flow through the gas pipe 111.

The discharge pipe 114 may be understood as a pipe extending from the discharge port of the compressor 110 to an outdoor heat exchanger 140.

The outdoor unit 10 may further include an oil separator 115 installed in the discharge pipe 114 to separate oil which is discharged together with the refrigerant from the compressor 110 and a recovery pipe 116 extending from the oil separator 115 to the suction pipe 112. Oil flowing through the recovery pipe 116 may be recovered into the compressor 110. An oil amount adjusting device 117 for adjusting (reducing) the flow amount of the recovered oil may be installed in the recovery pipe 116. For example, the oil amount adjusting device 117 may include a capillary tube.

The discharge pipe 114 may be provided with a first check valve 118 that allows only one-way flow of a refrigerant. The first check valve 118 may allow flow of a refrigerant from the compressor 110 to the outdoor heat exchanger 140, in particular, to a first branch portion 114*a*, and restrict the flow of the refrigerant in the opposite direction. For example, the first check valve 118 may be disposed at the outlet side of the oil separator 115.

The discharge pipe 114 may be installed with a first outdoor valve 121 that selectively allows flow of a refrigerant from the compressor 110 to the outdoor heat exchanger 140. The first outdoor valve 121 may be installed between the first branch portion 114*a* and a second branch portion 114*b*. That is, the first branch portion 114*a* may be disposed at the inlet side of the first outdoor valve 121 and the second branch portion 114*b* may be disposed at the outlet side of the first outdoor valve 121.

The first branch portion 114*a* may be understood as a point at which the discharge pipe 114 and a first bypass pipe 130 are connected, and the second branch portion 114*b* may be understood as a point at which the discharge pipe 114 and the suction connection pipe 125 are connected.

For example, the first outdoor valve 121 may include a solenoid valve which is able to be controlled in on/off manner or an electronic expansion valve of which an opening degree is controllable.

An outdoor heat exchanger 140 may be installed at an outlet side of the first outdoor valve 121. The outdoor heat exchanger 140 is a device that performs heat exchange between a refrigerant and outside air, and an outdoor fan 140*a* for blowing outside air toward the outdoor heat exchanger 140 may be provided at one side of the outdoor heat exchanger 140. When the outdoor fan 140*a* is driven, the refrigerant flowing through the outdoor heat exchanger 140 may be subjected to heat exchange with outside air.

A liquid pipe 170 may be connected to the outlet side of the outdoor heat exchanger 140. The liquid pipe 170 may extend from the outdoor heat exchanger 140 to a first service valve 175.

A receiver 160 and a second check valve 162 may be installed in the liquid pipe 170. For example, the second check valve 162 may be disposed at an outlet side of the receiver 160.

The receiver 160 may form a chamber for storing a refrigerant condensed in the outdoor heat exchanger 140. A liquid refrigerant stored in the chamber may flow toward the first service valve 175. The second check valve 162 may allow flow of a refrigerant from the outdoor heat exchanger 140 toward the first service valve 175 and restrict the flow of the refrigerant in the opposite direction.

A supercooler 164 may be installed at the outlet side of the second check valve 162. In the supercooler 164, heat exchange may be made between a main refrigerant condensed in the outdoor heat exchanger 140 and a branch refrigerant branched from the main refrigerant.

The outdoor unit 10 may further include an injection pipe 165 that is branched from the liquid pipe 170 and extends to the compressor 110 to guide the branch refrigerant to flow into the compressor 110. A supercooling expansion device 167 for depressurizing the branch refrigerant may be installed in the injection pipe 165.

Through heat exchange in the supercooler 164, the main refrigerant may be supercooled, and the branch refrigerant may be vaporized and injected into the compressor 110.

The outdoor unit 10 may further include a first bypass pipe 130 that guide a high-pressure refrigerant (hot gas refrigerant) compressed by the compressor 110 to bypass the outdoor heat exchanger 140. The first bypass pipe 130 may be connected to the first branch portion 114*a* of the discharge pipe 114.

When a defrosting operation of the cooling system 1 is performed, the hot gas refrigerant compressed by the compressor 110 may be branched from the first branch portion 114*a* and flow through the first bypass pipe 130.

The first bypass pipe 130 may be connected to a fourth branch portion 172 of the liquid pipe 170. That is, one end of the first bypass pipe 130 may be coupled to the first branch portion 114*a*, and the other end may be coupled to the fourth branch portion 172. During the defrosting operation of the cooling system 1, the hot gas refrigerant may be introduced into the first bypass pipe 130 from the first branch portion 114*a*, and then introduced into the liquid pipe 170 from the fourth branch portion 172.

A second outdoor valve 122 that selectively allows flow of a refrigerant through the first bypass pipe 130 may be installed on the first bypass pipe 130. For example, the second outdoor valve 122 may include a solenoid valve which is able to be controlled in on/off manner or an electronic expansion valve of which an opening degree is controllable. When the cooling operation of the cooling system 1 is performed, the second outdoor valve 122 may be controlled to be closed, and may be controlled to be opened when the defrosting operation is performed.

The outdoor unit 10 may further include a second bypass pipe 135 which is branched from the third branch portion 171 of the liquid pipe 170 and extends to the third service valve 176. One end of the second bypass pipe 135 may be connected to the third branch portion 171, and the other end may be connected to the third service valve 176.

A bypass expansion device 136 may be installed in the second bypass pipe 135. For example, the bypass expansion device 136 may include an electronic expansion valve.

During the defrosting operation of the cooling system 1, a refrigerant that has defrosted while passing through the first evaporator 220 or the second evaporator 230 may pass through the second bypass pipe 135 and flow into the outdoor heat exchanger 140. In this case, the refrigerant may be depressurized in the bypass expansion device 136 and then evaporated in the outdoor heat exchanger 140.

The outdoor unit 10 may further include a suction connection pipe 125 extending from the second branch portion 114*b* of the discharge pipe 114 to the fifth branch portion 113 of the gas pipe 111. One end of the suction connection pipe 125 may be coupled to the second branch portion 114*b*, and the other end may be coupled to the fifth branch portion 113. The fifth branch part 113 is a point where the suction connection pipe 125 and the gas pipe 111 are connected, and may be disposed at the inlet side of the gas-liquid separator 105.

The second branch portion 114*b* may be disposed between the first branch portion 114*a* and the outdoor heat exchanger 140 based on refrigerant flow, and the first outdoor valve 121 may be disposed between the first branch portion and the second branch portion 114*a* and 114*b*.

During the defrosting operation of the cooling system 1, the refrigerant evaporated from the outdoor heat exchanger 140 may be combined with a gaseous refrigerant flowing into the gas pipe 111 from the fifth branch portion 113 while flowing through the suction connection pipe 125. The combined refrigerant may be sucked into the compressor 110.

The suction connection pipe 125 may be installed with a third outdoor valve 123 that selectively allows flow of a refrigerant through the suction connection pipe 125. For example, the third outdoor valve 123 may include a solenoid valve which is able to be controlled in on/off manner or an electronic expansion valve of which an opening degree is controllable. When the cooling operation of the cooling system 1 is performed, the third outdoor valve 123 may be controlled to be closed, and may be controlled to be opened when the defrosting operation is performed.

The connection unit 50 may include a first connection pipe 214 extending from the first connection portion C1 to the fourth connection portion C4. A first defrost valve 215 for selectively opening the first connection pipe 214 may be installed in the first connection pipe 214. For example, the first defrost valve 215 may include a solenoid valve capable of being controlled in on/off manner.

The connection unit 50 may further include a second connection pipe 217 extending from the fifth connection portion C5 to the second connection portion C2. A second defrost valve 228 may be installed in the second connection pipe 217. For example, the second defrost valve 228 may include a three-way valve.

The connection unit 50 may further include a third connection pipe 218 extending from the sixth connection portion C6 to the second connection pipe 217. The third connection pipe 218 may be connected to the second connection pipe 217 at the seventh branch portion 227*a* of the second connection pipe 217. A third defrost valve 238 may be installed in the third connection pipe 218. For example, the third defrost valve 238 may include a three-way valve.

The connection unit 50 may further include a fourth connection pipe 219 extending from the first connection pipe 214 to the third connection portion C3. The fourth connection pipe 219 may be connected to the first connection pipe 214 at the eighth branch portion 214*b* of the first connection pipe 214.

The connection unit 50 may further include a third bypass pipe 240 extending from the first connection pipe 214 to the second defrost valve 228. A sixth branch portion 214*a* to which the third bypass pipe 240 is connected may be provided in the first connection pipe 214. During the defrosting operation of the cooling system 1, hot gas may flow from the sixth branch portion 214*a* of the first connection pipe 214 to the third bypass pipe 240, and may be introduced into the first evaporator 220 through the second defrost valve 228.

The connection unit 50 may further include a connection pipe 242 branched from the third bypass pipe 240 and connected to the third defrost valve 238. The first and second ports of the third defrost valve 238 may be connected to the third connection pipe 218, and the third port may be connected to the connection pipe 242. The first and second ports of the second defrost valve 228 may be connected to the second connection pipe 217, and the third port may be connected to the third bypass pipe 240.

The indoor unit 30 may include a plurality of evaporators 220 and 230 for evaporating a refrigerant. The plurality of evaporators 220 and 230 may include a first evaporator 220 and a second evaporator 230. During the cooling operation of the cooling system 1, the refrigerant may be evaporated in the first and second evaporators 220 and 230. On the other hand, during the defrosting operation of the cooling system 1, one of the first evaporator 220 and the second evaporator 230 may perform defrosting and the other may evaporate a refrigerant.

The indoor unit 30 may include an evaporator inlet pipe 210 extending from the fourth connection portion C4 of the connection unit 50 to the inlet side of the first and second evaporators 220 and 230. The evaporator inlet pipe 210 may be branched and connected to the first and second evaporators 220 and 230, individually. The branch pipes connected to the first and second evaporators 220 and 230 may be referred to as "first evaporator branch pipe" and "second evaporator branch pipe", respectively.

A first evaporator expansion device 225 may be installed in the first evaporator branch pipe, and a second evaporator expansion device 235 may be installed in the second evaporator branch pipe. For example, each of the first evaporator expansion device 225 and the second evaporator expansion device 235 may include an electronic expansion valve (EEV) for depressurizing a refrigerant.

A first evaporator fan 220*a* may be installed at one side of the first evaporator 220, and a second evaporator fan 230*a* may be installed at one side of the second evaporator 230. For example, the first and second evaporator fans 220*a* and 230*a* may be installed on a wall of a storage to blow cool air toward the storage.

The indoor unit 30 may further include a first evaporator outlet pipe 227 which is disposed at the outlet side of the first evaporator 220 and extends to the fifth connection portion C5 of the connection unit 50 and a second evaporator outlet pipe 237 which is disposed at the outlet side of the second evaporator 230 and extends to the sixth connection portion C6 of the connection unit 50.

During the cooling operation of the cooling system 1, refrigerants evaporated from the first and second evaporators 220 and 230 may flow into the connection unit 50 through the first and second evaporator outlet pipes 227 and 228, respectively.

On the other hand, during the defrosting operation of the cooling system 1, in particular, the defrosting operation of the first evaporator 220, hot gas passing through the third bypass pipe 240 and the second defrost valve 228 may be introduced into the first evaporator 220 through the first evaporator outlet pipe 227, so that the hot gas is used for defrosting, and is then depressurized in the second evaporator expansion device 235, and evaporated in the second evaporator 230. The evaporated refrigerant may flow into the sixth connection portion C6 of the connection unit 50 through the second evaporator outlet pipe 237.

During the defrosting operation of the cooling system 1, in particular, the defrosting operation of the second evaporator 230, hot gas passing through the third bypass pipe 240, the connection pipe 242, and the third defrost valve 238 may be introduced into the second evaporator 230 through the second evaporator outlet pipe 237, so that the hot gas is used for defrosting, and is then depressurized in the first evaporator expansion device 225, and evaporated in the first evaporator 220. The evaporated refrigerant may flow into the fifth connection portion C5 of the connection unit 50 through the first evaporator outlet pipe 227.

Meanwhile, during the defrosting operation of the first evaporator 220 or the second evaporator 230, at least a part of the refrigerants that have used to defrost the evaporator may be introduced to the connection unit 50 through the fourth connection portion C4 and flows from the eighth branch portion 214*b* to the fourth connection pipe 219 to flow through the second bypass pipe 135 of the outdoor unit 10.

Figure 2:
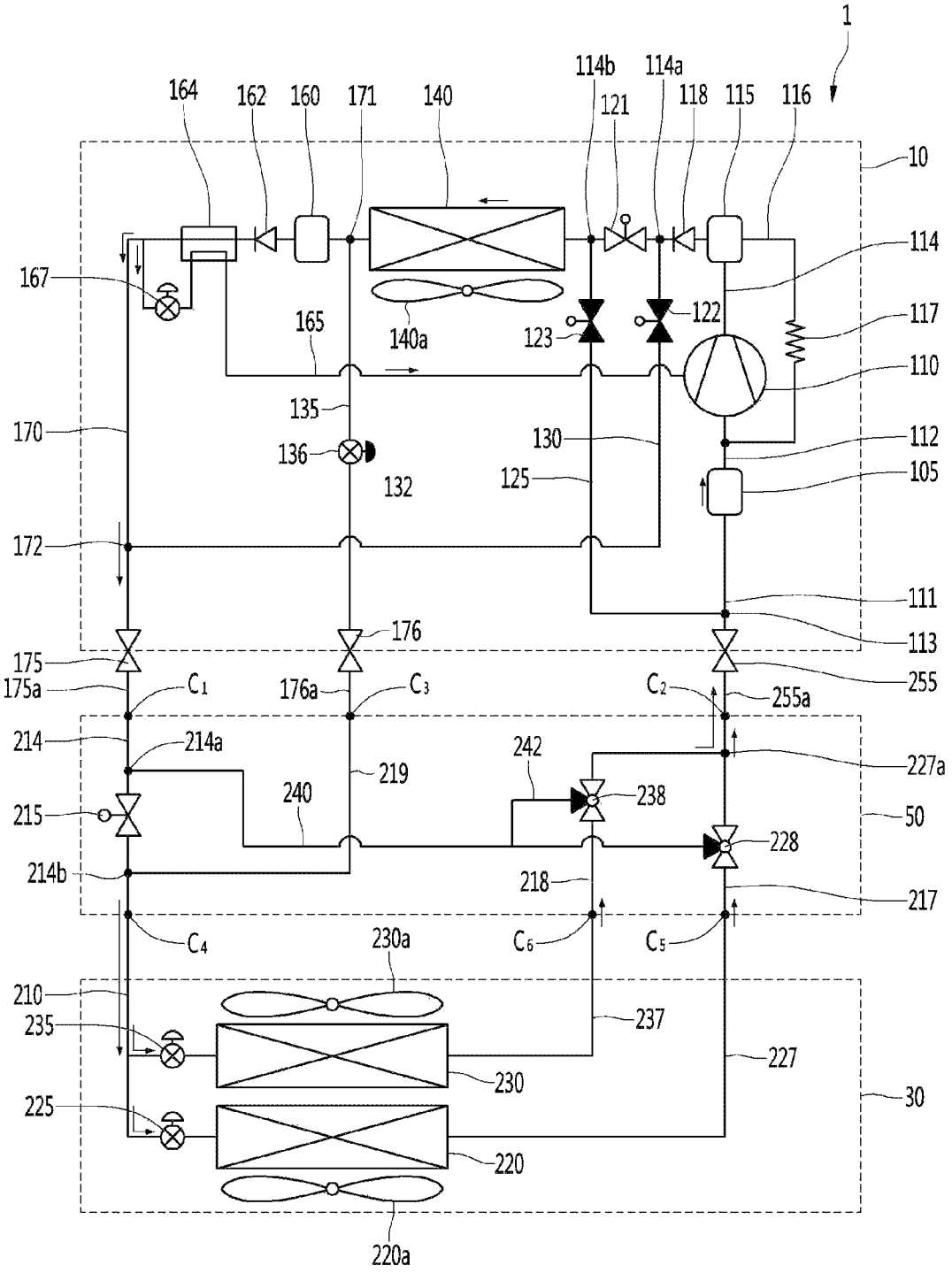
FIG. 2 is a cycle diagram showing a flow state of a refrigerant when performing a cooling operation of a cooling system according to an embodiment of the present disclosure.

FIG. 2 is a cycle diagram showing a flow state of a refrigerant when performing a cooling operation of a cooling system according to an embodiment of the present disclosure.

Referring to FIG. 2, when performing the cooling operation of the cooling system 1 according to the embodiment of the present disclosure, a high-pressure refrigerant compressed by the compressor 110 may pass through the first outdoor valve 121, which is opened, through the discharge pipe 114 and may be introduced into the outdoor heat exchanger 140 and condensed. In this case, the second outdoor valve 122 and the third outdoor valve 123 may be controlled to be closed.

The refrigerant discharged from the outdoor heat exchanger 140 may be supercooled while flowing through the liquid pipe 170 and passing through the supercooler 164. The refrigerant supercooled in the supercooler 164 may be discharged through the first service valve 175 and may be introduced into the connection unit 50 through the first connection portion C1.

Meanwhile, the branch refrigerant passing through the supercooler 164 may be injected into the compressor 110 through an injection pipe 165.

The refrigerant introduced into the connection unit 50 may flow through the first connection pipe 214 and may be branched and introduced into the first and second evaporators 220 and 230 through the evaporator inlet pipe 210. In this case, one port of the second defrost valve 228 to which the third bypass pipe 240 is connected and one port of the third defrost valve 238 to which the connection pipe 242 is connected may be closed so that the flow of the refrigerant to the third bypass pipe 240 and the connection pipe 242 may be restricted.

The refrigerant branched from the evaporator inlet pipe 210 may be evaporated in each of the first and second evaporators 220 and 230 to generate cold air, and the generated cold air may be supplied into the inside of the storage by the first and second evaporator fans 220*a* and 230*a*.

The refrigerant evaporated from the first and second evaporators 220 and 230 may flow through the first and second evaporator outlet pipes 227 and 237, respectively, and may flow into the connection unit 50. In detail, the refrigerant flowing through the first evaporator outlet pipe 227 may be introduced into the connection unit 50 through the fifth connection portion C5 and pass through the second defrost valve 228. The refrigerant flowing through the second evaporator outlet pipe 237 may be introduced into the connection unit 50 through the sixth connection portion C6 and may pass through the third defrost valve 238. The refrigerant that has passed through the third defrost valve 238 may be combined with a refrigerant that has passed through the second defrost valve 228 in the seventh branch portion 227*a* of the second connection pipe 217.

The combined refrigerant may be discharged from the connection unit 50 through the second connection portion C2 and be introduced into the outdoor unit 10 through the second service valve 255. The refrigerant introduced into the outdoor unit 10 may flow through the gas pipe 111 and may be sucked into the compressor 110 through the gas-liquid separator 105. Such a cycle may be repeated, and the storage may be efficiently cooled by the circulation of such a refrigerant cycle.

Figure 3:
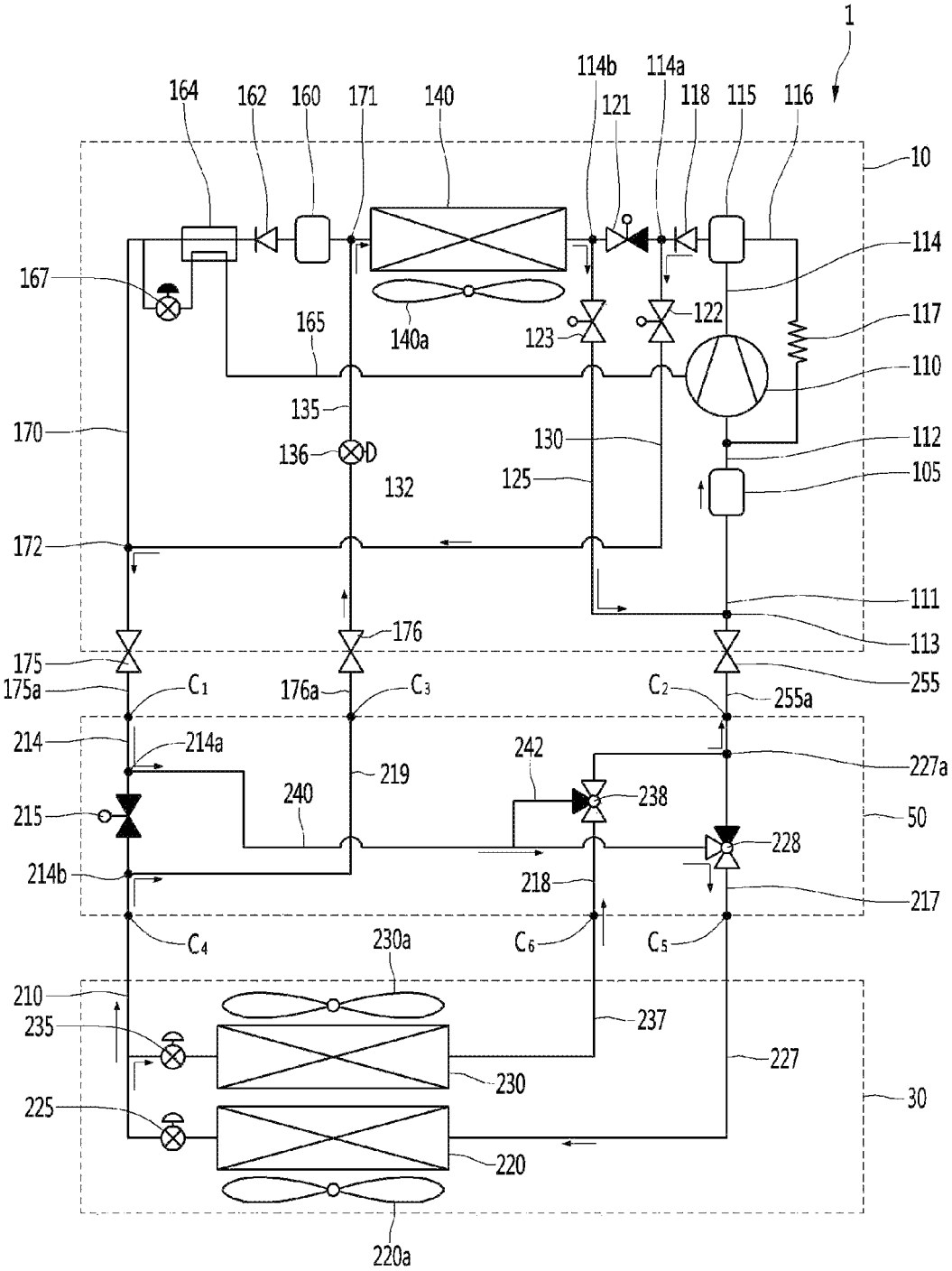
FIG. 3 is a cycle diagram showing a flow state of a refrigerant when performing a defrosting operation of a first evaporator according to an embodiment of the present disclosure.

FIG. 3 is a cycle diagram showing a flow state of a refrigerant when performing a defrosting operation of a first evaporator according to an embodiment of the present disclosure.

Referring to FIG. 3, when the defrosting operation of the cooling system 1 according to an embodiment of the present disclosure is performed, in particular when the defrosting operation of the first evaporator 220 is performed, a high-pressure refrigerant compressed by the compressor 110 may be introduced into the first bypass pipe 130 from the first branch portion 114*a* through the discharge pipe 114. In this case, since the first outdoor valve 121 is closed and the second outdoor valve 122 is opened, the flow of the refrigerant into the outdoor heat exchanger 140 may be restricted.

The refrigerant flowing through the first bypass pipe 130 may be introduced into the liquid pipe 170 from the fourth branch portion 172 and may flow into the first service valve 175. In this case, since the supercooling expansion device 167 is closed, the flow of the refrigerant from the fourth branch portion 172 to the injection pipe 165 may be restricted. The second check valve 162 may restrict the refrigerant from flowing into the outdoor heat exchanger 140 from the fourth branch portion 172.

The refrigerant discharged from the outdoor unit 10 through the first service valve 175 may be introduced into the connection unit 50 through the first connection portion C1, and flow into the third bypass pipe 240 from the sixth branch portion 214*a*. In this case, since the first defrost valve 215 is closed, the flow of the refrigerant to the evaporator inlet pipe 210 may be restricted.

The refrigerant flowing through the third bypass pipe 240 may be introduced into the second defrost valve 228 and may be introduced into the first evaporator 220 through the first evaporator outlet pipe 227. In this case, since one port of the third defrost valve 238 to which the connection pipe 242 is connected is closed, the flow of a refrigerant to the connection pipe 242 may be restricted.

The refrigerant flowing into the first evaporator 220 may form a high-pressure hot gas. Accordingly, while the hot gas refrigerant passes through the first evaporator 220, the first evaporator 220 may be defrosted and the refrigerant may be condensed. At least a part of the refrigerants that have passed through the first evaporator 220 may be depressurized in the second evaporator expansion device 235 and may be evaporated in the second evaporator 230. In this case, since the first evaporator expansion device 225 is fully opened, the refrigerant may not be depressurized while passing through the first evaporator expansion device 225.

When the refrigerant is evaporated in the second evaporator 230, cold air is generated, and the generated cold air may be supplied to the internal space of the storage by driving the second evaporator fan 230*a*. As described above, since the second evaporator 230 may perform a cooling operation while the first evaporator 220 is defrosted, a phenomenon in which the internal temperature of the storage is rapidly increased may be prevented.

The refrigerant evaporated in the second evaporator 230 may pass through the third defrost valve 238 through the second evaporator outlet pipe 237 and may be discharged from the connection unit 50 through the second connection portion C2. The refrigerant discharged from the connection unit 50 may be introduced into the outdoor unit 10 through the second service valve 255 to flow through the gas pipe 111. The refrigerant may be sucked into the compressor 110 through the gas-liquid separator 105.

On the other hand, a part of the refrigerant which has defrosted the first evaporator 220 may be introduced into the connection unit 50 through the fourth connection portion C4, and flow through the fourth connection pipe 219 in the eighth branch portion 214*b*. That is, a part of the refrigerant that have passed through the first evaporator 220 may be introduced into the second evaporator expansion device 235, and the remaining refrigerant may flow into the fourth connection portion C4. In this case, since the first defrost valve 215 is closed, the refrigerant may be restricted from flowing toward the first connection portion C1.

The refrigerant which has flowed through the fourth connection pipe 219 may be introduced into the outdoor unit 10 through the third service valve 176 and flow through the second bypass pipe 135. The refrigerant may be depressurized in the bypass expansion device 136 while flowing through the second bypass pipe 135, and the depressurized refrigerant may be introduced into the outdoor heat exchanger 140 from the third branch portion 171. That is, the outdoor heat exchanger 140 may function as an evaporator, and in this process, the refrigerant may absorb heat from the outside air, so that the cooling system 1 has the advantage of securing the amount of heat required for defrosting from an external heat source.

On the other hand, since the refrigerant depressurized by the bypass expansion device 136 has a low pressure, the refrigerant may be restricted from flowing from the third branch portion 171 into the fourth branch portion 172 through which a high-pressure hot gas flows due to a pressure difference.

The refrigerant evaporated from the outdoor heat exchanger 140 may be introduced into the suction connection pipe 125 from the second branch portion 114*b*. That is, since the third outdoor valve 123 installed in the suction connection pipe 125 is opened and the first outdoor valve 121 is closed, the refrigerant passing through the outdoor heat exchanger 140 may flow into the suction connection pipe 125.

The refrigerant in the suction connection pipe 125 may be combined with the refrigerant flowing through the gas pipe 111 in the fifth branch portion 113. The combined refrigerant may be sucked into the compressor 110 through the gas-liquid separator 105. Such a cycle may be repeated, and the defrosting operation of a certain evaporator and the cooling operation of the storage may be performed simultaneously or continuously due to the circulation of the refrigerant cycle.

Figure 4:
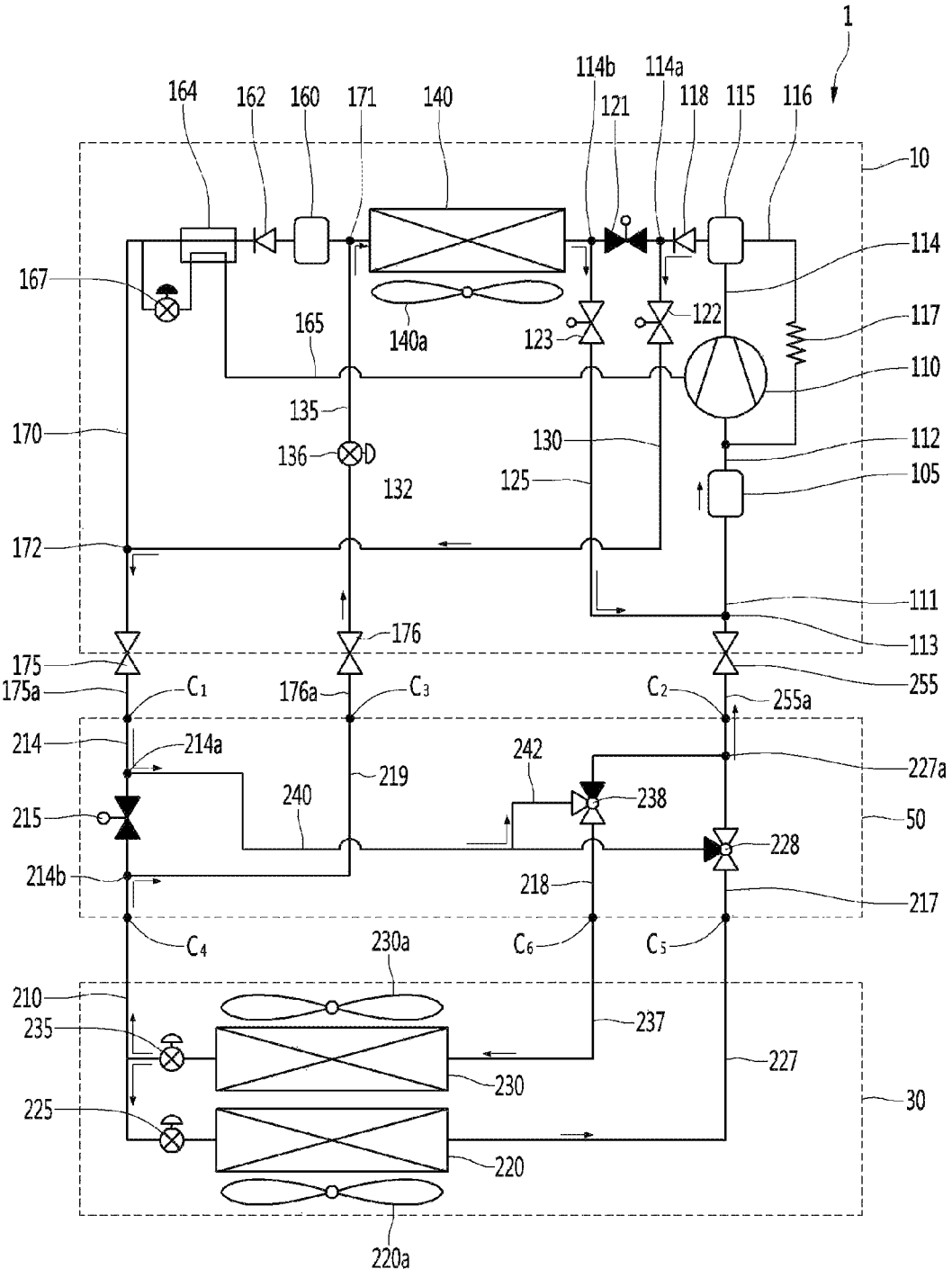
FIG. 4 is a cycle diagram showing a flow state of a refrigerant when performing a defrosting operation of a second evaporator according to an embodiment of the present disclosure.

FIG. 4 is a cycle diagram showing a flow state of a refrigerant when performing a defrosting operation of a second evaporator according to an embodiment of the present disclosure.

Referring to FIG. 4, when the defrosting operation of the cooling system 1 according to an embodiment of the present disclosure is performed, in particular when the defrosting operation of the second evaporator 230 is performed, the flow of a refrigerant in the outdoor unit 10 is the same as described with reference to FIG. 3, and is different from described with reference to FIG. 3 in the flow of a refrigerant in the indoor unit 30 and the connection unit 50. Accordingly, the description with reference to FIG. 3 is referred to with respect to the same portion as in FIG. 3, and a portion different from the description with reference to FIG. 3 will be mainly described.

The refrigerant compressed by the compressor 110 may flow from the first branch portion 114*a* to the first bypass pipe 130 and flow from the fourth branch portion 172 to the liquid pipe 170. The refrigerant may be discharged from the outdoor unit 10 through the first service valve 175 and may be introduced into the connection unit 50 through the first connection portion C1.

The refrigerant introduced into the connection unit 50 may flow through the first connection pipe 214. Since the first defrost valve 215 is closed, the refrigerant may flow from the sixth branch portion 214*a* to the third bypass pipe 240.

The refrigerant in the third bypass pipe 240 may be introduced into the third defrost valve 238 through the branched connection pipe 242, then discharged from the third defrost valve 238 and introduced into the second evaporator 230. In this case, since one port of the second defrost valve 228 to which the third bypass pipe 240 is connected is closed, the refrigerant may be restricted from being introduced into the second defrost valve 228.

The refrigerant introduced into the second evaporator 230, that is, high-pressure hot gas may defrost the second evaporator 230. At least a part of the refrigerants that have passed through the second evaporator 230 may be depressurized in the first evaporator expansion device 225 and may be evaporated in the first evaporator 220. In this case, since the second evaporator expansion device 235 is fully opened, the refrigerant may not be depressurized while passing through the second evaporator expansion device 235.

When the refrigerant is evaporated in the first evaporator 220, cold air is generated, and the generated cold air may be supplied to the internal space of the storage by driving the first evaporator fan 220*a*. As described above, since the first evaporator 220 may perform a cooling operation while the second evaporator 230 is defrosted, a phenomenon in which the internal temperature of the storage is rapidly increased may be prevented.

The refrigerant evaporated in the first evaporator 220 may pass through the second defrost valve 228 through the first evaporator outlet pipe 227 and may be discharged from the connection unit 50 through the second connection portion C2. The refrigerant discharged from the connection unit 50 may be introduced into the outdoor unit 10 through the second service valve 255, flow through the gas pipe 111 and be sucked into the compressor 110.

On the other hand, a part of the refrigerant which has defrosted the second evaporator 230 may be introduced into the connection unit 50 through the fourth connection portion C4, and flow through the fourth connection pipe 219 in the eighth branch portion 214*b*. That is, a part of the refrigerant that have passed through the second evaporator 230 may be introduced into the first evaporator expansion device 225, and the remaining refrigerant may flow into the fourth connection portion C4. In this case, since the first defrost valve 215 is closed, the refrigerant may be restricted from flowing toward the first connection portion C1.

The refrigerant which has flowed through the fourth connection pipe 219 may be introduced into the outdoor unit 10 through the third service valve 176 and flow through the second bypass pipe 135. The refrigerant may be depressurized in the bypass expansion device 136 while flowing through the second bypass pipe 135, and the depressurized refrigerant may be introduced into the outdoor heat exchanger 140 from the third branch portion 171. That is, the outdoor heat exchanger 140 may function as an evaporator, and in this process, the refrigerant may absorb heat from the outside air, so that the cooling system 1 has the advantage of securing the amount of heat required for defrosting from an external heat source.

On the other hand, since the refrigerant depressurized by the bypass expansion device 136 has a low pressure, the refrigerant may be restricted from flowing from the third branch portion 171 into the fourth branch portion 172 through which a high-pressure hot gas flows due to a pressure difference.

The refrigerant evaporated from the outdoor heat exchanger 140 may be introduced into the suction connection pipe 125 from the second branch portion 114*b*. That is, since the third outdoor valve 123 installed in the suction connection pipe 125 is opened and the first outdoor valve 121 is closed, the refrigerant passing through the outdoor heat exchanger 140 may flow into the suction connection pipe 125.

The refrigerant in the suction connection pipe 125 may be combined with the refrigerant flowing through the gas pipe 111 in the fifth branch portion 113. The combined refrigerant may be sucked into the compressor 110 through the gas-liquid separator 105. Such a cycle may be repeated, and the defrosting operation of a certain evaporator and the cooling operation of the storage may be performed simultaneously or continuously due to the circulation of the refrigerant cycle.

The invention claimed is:

1. A cooling system for cold storage, comprising:
a compressor configured to compress a refrigerant;
an outdoor heat exchanger disposed at an outlet side of the compressor;
a first outdoor valve disposed between the compressor and the outdoor heat exchanger to selectively restrict inflow of the refrigerant into the outdoor heat exchanger;
a first bypass pipe branched from an inlet side of the first outdoor valve to guide the refrigerant to bypass the outdoor heat exchanger;
a suction connection pipe branched from an outlet side of the first outdoor valve to guide the refrigerant passing through the outdoor heat exchanger to a suction side of the compressor;
a first evaporator into which the refrigerant flowing through the first bypass pipe is introduced to perform defrost;
a second evaporator disposed at an outlet side of the first evaporator to evaporate the refrigerant passing through the first evaporator;
a discharge pipe configured to extend from the outlet side of the compressor to the outdoor heat exchanger;
a liquid pipe disposed at an outlet side of the outdoor heat exchanger, the refrigerant condensed in the outdoor heat exchanger flowing through the liquid pipe;
a first branch portion connected to a first end of the first bypass pipe;
a second branch portion to which the suction connection pipe is connected;
a third branch portion formed in the liquid pipe;
a second bypass pipe connected to the third branch portion, the refrigerant used to defrost the first evaporator flowing through the second bypass pipe;
a first connection pipe connected to the liquid pipe and at which a first defrost valve is disposed;
a third bypass pipe branched from the first connection pipe to guide the refrigerant to the first evaporator;
a first evaporator outlet pipe connected to the first evaporator;
a second defrost valve connected to the third bypass pipe and the first evaporator outlet pipe;
a connection pipe branched from the third bypass pipe;
a second evaporator outlet pipe connected to the second evaporator; and
a third defrost valve connected to the connection pipe and the second evaporator outlet pipe, wherein the refrigerant compressed by the compressor is restricted from being immediately introduced into the outdoor heat exchanger and instead flows into the first evaporator through the first bypass pipe to perform defrosting during a defrosting operation.

2. The cooling system of claim 1, further comprising:
a bypass expansion device disposed in the second bypass pipe.

3. The cooling system of claim 1, further comprising:
a second outdoor valve disposed in the first bypass pipe.

4. The cooling system of claim 3, further comprising:
a third outdoor valve disposed in the suction connection pipe.

5. The cooling system of claim 1, further comprising:
an oil separator disposed on the discharge pipe.

6. The cooling system of claim 5, further comprising:
a recovery pipe extending between the oil separator and a suction pipe at an inlet side of the compressor; and
a capillary tube disposed on the recovery pipe.

7. The cooling system of claim 1, further comprising:
a receiver; and
a check valve disposed in the liquid pipe.

8. The cooling system of claim 7, further comprising:
a supercooler provided at an outlet side of the check valve.

9. The cooling system of claim 1, wherein the liquid pipe further includes a fourth branch portion to which a second end of the first bypass pipe is connected.

10. The cooling system of claim 9, further comprising:
a gas pipe disposed at a suction side of the compressor, the refrigerant evaporated in the second evaporator flowing through the gas tube, wherein the gas pipe includes a fifth branch portion to which the suction connection pipe is connected.

11. The cooling system of claim 10, further comprising:
a gas-liquid separator disposed between the gas pipe and a suction pipe at an inlet side of the compressor.

12. The cooling system of claim 1, further comprising:
an outdoor unit in which the compressor and the outdoor heat exchanger are disposed, and an indoor unit in which the first and second evaporators are disposed; and
a connection unit disposed between the outdoor unit and the indoor unit and connected to the outdoor unit with a three-way pipe and to the indoor unit with the three-way pipe.

13. The cooling system of claim 12, wherein the outdoor unit is detachably connected to the connection unit.

14. The cooling system of claim 13, further comprising:

a plurality of service valves between the outdoor unit and the connection unit.

* * * * *